US012276273B2

(12) United States Patent
Ganem et al.

(10) Patent No.: US 12,276,273 B2
(45) Date of Patent: Apr. 15, 2025

(54) SEALED PERISTALTIC PUMP FOR HOUSEHOLD ELECTRIC APPLIANCE

(71) Applicant: SEB S.A., Ecully (FR)

(72) Inventors: Mathias Ganem, Lyons (FR); Régis Fereyre, Lyons (FR); Johan Sabattier, Tassin la Demi Lune (FR)

(73) Assignee: SEB S.A. (FR)

( * ) Notice: Subject to any disclaimer, the term of this patent is extended or adjusted under 35 U.S.C. 154(b) by 251 days.

(21) Appl. No.: 17/287,813

(22) PCT Filed: Oct. 17, 2019

(86) PCT No.: PCT/EP2019/078176
§ 371 (c)(1),
(2) Date: Apr. 22, 2021

(87) PCT Pub. No.: WO2020/083736
PCT Pub. Date: Apr. 30, 2020

(65) Prior Publication Data

US 2021/0381502 A1 Dec. 9, 2021

(30) Foreign Application Priority Data

Oct. 22, 2018 (FR) ..... 1859755

(51) Int. Cl.
*F04B 43/09* (2006.01)
*F04B 53/16* (2006.01)

(52) U.S. Cl.
CPC ..... *F04B 43/09* (2013.01); *F04B 53/16* (2013.01)

(58) Field of Classification Search
CPC ..... F04B 1/0443; F04B 43/09; F04B 53/16; F04B 43/1253; F04B 53/22; F04B 43/00
See application file for complete search history.

(56) References Cited

U.S. PATENT DOCUMENTS

| | | | | |
|---|---|---|---|---|
| 3,421,447 A | | 1/1969 | Jackson et al. | |
| 4,545,744 A | * | 10/1985 | Weber | F04B 43/1276 417/477.7 |
| 4,661,045 A | * | 4/1987 | Winston | B05C 17/0333 417/9 |
| 9,562,528 B2 | * | 2/2017 | Warren | F04B 43/1238 |
| 2007/0140880 A1 | * | 6/2007 | Fulmer | F04B 43/1253 417/477.1 |

(Continued)

FOREIGN PATENT DOCUMENTS

| | | |
|---|---|---|
| CN | 203614372 U | 5/2014 |
| EP | 2449909 A1 | 5/2012 |

(Continued)

OTHER PUBLICATIONS

International Search Report for PCT/EP2019/078176 mailed Dec. 19, 2019; 2 pages.

*Primary Examiner* — Philip E Stimpert
(74) *Attorney, Agent, or Firm* — Lerner David LLP

(57) ABSTRACT

The invention relates to a peristaltic pump (6) for a household electric appliance comprising a pump body (60) defining a chamber (68) in which a deformable hose is located (63), which is intended to contain a liquid to be moved, characterized in that the peristaltic pump (6) comprises a sealing device (661, 662, 663) designed to contain the liquid inside the chamber (68) in the event of rupture of the deformable hose (63).

19 Claims, 3 Drawing Sheets

(56) References Cited

U.S. PATENT DOCUMENTS

| | | | | |
|---|---|---|---|---|
| 2010/0209263 | A1* | 8/2010 | Mazur | F04B 43/084<br>417/321 |
| 2012/0111355 | A1* | 5/2012 | Vacheron | A45D 1/04<br>132/228 |
| 2012/0111356 | A1 | 5/2012 | Vacheron et al. | |
| 2014/0271293 | A1* | 9/2014 | Gledhill, III | F04B 43/08<br>29/525.08 |

FOREIGN PATENT DOCUMENTS

| | | | |
|---|---|---|---|
| EP | 2449910 | A1 | 5/2012 |
| EP | 2449912 | A1 | 5/2012 |

* cited by examiner

SEALED PERISTALTIC PUMP FOR HOUSEHOLD ELECTRIC APPLIANCE

CROSS REFERENCE TO RELATED APPLICATIONS

The present application is a national phase entry under 35 U.S.C. § 371 of International Application No. PCT/EP2019/078176 filed Oct. 17, 2019, published in French, which claims priority from French Patent Application No. 1859755 filed Oct. 22, 2018, all of which are incorporated herein by reference.

TECHNICAL FIELD

The present invention relates to the field of peristaltic pumps used in household appliances and preferably in hairstyling appliances.

The invention also relates to household appliances, and in particular hairstyling appliances, containing peristaltic pumps.

More particularly, the invention relates to a peristaltic pump for a household appliance comprising a pump body defining a chamber in which there is a deformable hose intended to contain a liquid to be moved.

The invention also relates to a household appliance, and preferably a hairstyling appliance, comprising a peristaltic pump as defined above.

STATE OF THE ART

Peristaltic pumps are known in industrial fields, for example documents CN203614372U or U.S. Pat. No. 3,421,447.

Patent EP 2 449 910 also discloses the use of a peristaltic pump in a hairstyling appliance. In particular, this document teaches the use of a peristaltic pump to adjust the flow of liquid in order to supply liquid to a means of vaporizing the liquid. Thus, according to the appliance described in this document, a peristaltic pump makes it possible to move a liquid, in particular water, so as to produce steam. The use of this type of pump makes it possible to obtain a hairstyling appliance with many advantages, including that of offering a leakproof fluid circuit. Indeed, in a peristaltic pump, the fluid transported is not in contact with any moving part, since it remains contained inside the deformable hose in the peristaltic pump, a hose that is regularly compressed by one or more rollers mounted on the rotor of the peristaltic pump, which causes the fluid to move. The fluid transport circuit is thus simplified or even simply reduced to a single hose, the one on the peristaltic pump.

Many of the benefits associated with the use of a peristaltic pump are due to the deformable hose on the pump. But, and this is also the main drawback of this type of pump, the hose is a wear part and it is generally a part that has to be replaced periodically in a peristaltic pump. This is a common replacement and does not pose any particular problems in industrial or medical fields where peristaltic pumps are frequently found. On the other hand, such a replacement is practically unthinkable for an application in household appliances, especially hairstyling appliances, in particular given the size of the components, the relatively low overall cost of these appliances, and especially the user who is not technically qualified to make such a replacement.

Therefore, it cannot be ruled out, in the case of hairstyling appliances, particularly given the wear of the hose as explained above, that the hose will deteriorate to the point of leaking (slits, holes, etc.) or even rupturing. Although very simple, the fluid transport circuit is no longer leakproof and the liquid spills into the appliance.

However, the presence of liquid, and particularly water, inside this type of appliance is not desirable. Indeed, these appliances are usually electrical appliances, at least insofar as they comprise a heating element to electrically heat a hairstyling surface, or even various electrical and electronic components. Consequently, the presence of liquid inside these appliances risks destroying their electrical and/or electronic components and therefore leading to a malfunction or even to the total breakdown of the hairstyling appliance. Moreover, the risk of electric shock for the user cannot be completely ruled out, especially since he/she generally holds his/her appliances in his/her hand, or even handles them in the immediate vicinity of his/her head, in the case of hairstyling appliances.

The same problems and same risks may occur if the pump hose disconnects from or tears off of a connector, for example consecutive to overpressure due to limescale in the appliance.

There is therefore a need to make this type of appliance safer, be it for the components of the appliance itself or for the user, particularly in case of rupture of the peristaltic pump hose.

SUMMARY OF THE INVENTION

The present invention aims to overcome the aforementioned drawbacks.

One of the purposes of the invention is to propose a peristaltic pump that is particularly safe, particularly if its hose ruptures.

Another purpose of the invention is to propose a peristaltic pump that is particularly compact.

Another purpose of the invention is to propose a reliable and robust peristaltic pump.

One of the purposes of the invention is to propose a hairstyling appliance that is particularly safe, in particular if the hose on the peristaltic pump ruptures.

Another purpose of the invention is to propose a hairstyling appliance that is particularly compact and ergonomic.

Another purpose of the invention is to propose a hairstyling appliance that is particularly reliable and robust.

The purposes are achieved by means of a peristaltic pump for a household electric appliance comprising a pump body defining a chamber in which there is a deformable hose intended to contain a liquid to be moved, said peristaltic pump comprising a sealing system designed to contain the liquid inside the chamber in the event of rupture of the deformable hose.

"Rupture of the deformable hose" means any deterioration which could lead to a loss of watertightness of the said hose, i.e., a leak of the liquid contained in the deformable hose. For example, this may be the result of a burst hose, a split hose, a pierced hose, excessive porosity of the hose, or accidental disconnection or unplugging of the hose, for example after to overpressure due to limescale in the appliance. "Chamber" refers to any three-dimensional space intended to accommodate at least one element, in this case the deformable hose on the pump.

This invention thus enables the liquid to be contained i.e., maintained, kept in the pump chamber and not spill out of the pump if the deformable hose were to rupture. Consequently, any rupture of the peristaltic pump hose has limited consequences since the liquid remains contained inside the pump and does not leak out of the pump, as would normally be the case with the pumps known in the prior art. It is therefore possible to install a pump as defined by the invention in spaces where any presence of liquid is normally to be avoided, for example in the immediate proximity of electrical or electronic components as will be detailed below.

It would be easy for a person skilled in the art to verify the result of the invention by means of a simple test. Indeed, he/she could, for example, pierce or unplug (i.e., disconnect) the deformable hose in order to simulate a liquid leak inside the chamber. The person skilled in the art would then just have to handle the peristaltic pump (or household appliance) in various positions, as he/she would during normal use. Then, the person skilled in the art could check if the liquid is flowing. A person skilled in the art could also check, for example by disassembling the housing of the household appliance containing the pump, if the liquid had touched an electrical or electronic component of the appliance, i.e., whether the liquid came into contact with said component when the appliance was being handled. Such verification is simple insofar as the component in question would, in the event of contact with the liquid, show significant damage (burns, corrosion, explosion, etc.).

According to a preferential embodiment, the chamber comprises a rotor in contact with the deformable hose, said rotor is connected to a drive shaft passing through the pump body, and the sealing system comprises a first sealing element which is arranged between the drive shaft and the pump body. Therefore, if the deformable hose ruptures, the liquid cannot leak through the gap between the drive shaft, which is a rotating moving part, and the pump body, which is a fixed part. According to this preferential embodiment, the first sealing element comprises a lip seal, and preferentially a double-lip seal. This type of seal, and particularly a double-lip seal, ensures a very good seal between a rotating shaft, in this case the drive shaft, against which the seal lip or lips press, and a fixed part, in this case the pump body, in which the seal is held.

According to another preferential embodiment, the peristaltic pump comprises a lid cooperating with the pump body, and the sealing system comprises a second sealing element arranged between the pump body and the lid. This construction then makes it possible to propose a peristaltic pump, the assembly and/or any maintenance of which are facilitated due to the presence of the lid, while ensuring a seal between the pump body and the lid should the deformable hose rupture. Advantageously, the second sealing element comprises a circular cross-section seal at least partially arranged around the rim of the pump body and the lid.

It could also be foreseen that, instead of passing through the pump body as described above, the drive shaft passes through the lid and that the first sealing element is positioned between the drive shaft and the lid.

According to another preferential embodiment, the peristaltic pump comprises an inlet connector intended to receive a liquid suction duct, and an outlet connector intended to receive a liquid discharge duct, connected to the deformable hose. The sealing system preferably comprises a third sealing element arranged between the pump body and at least one of the inlet or outlet connectors. Alternatively, the third sealing element is arranged between the lid and at least one of the inlet or outlet connectors. Alternatively, the third sealing element is arranged between the pump body, the lid, and at least one of the inlet or outlet connectors. Such a construction ensures the seal between the chamber and the outside of the pump at the pump connectors, regardless of the spatial orientation of the pump. For example, the pump can be positioned with at least one if not both of its connectors arranged at the bottom, and even if the deformable hose breaks, there will be no liquid leakage at the connectors, i.e., between the connectors and the pump body or the lid, for example.

According to a first variant of the preceding preferential embodiment, the third sealing element comprises a plate, preferentially made of silicone, through which passes each of said inlet and outlet connectors. Said plate is then arranged between the pump body and/or the pump lid and around at least one of the inlet or outlet connectors. Advantageously, the plate comprises two openings, and preferentially two holes, each of the openings containing one of the connectors. This construction ensures the sealing of the chamber including at the connectors, if these parts are attached to the pump (for example, they are not molded with the pump body or the lid, as is frequently the case with pumps). Moreover, this solution makes it possible to dismantle the connectors without damaging the connectors or the pump itself. The use of a silicone plate is particularly advantageous and inexpensive in the event that the two connectors are located close to each other and on the same plane forming a surface of the pump as will be detailed below.

According to a second variant of the aforementioned preferential embodiment, the third sealing element is arranged between the pump body and/or optionally the lid and each of the inlet and outlet connectors, said third sealing element comprising two O-rings. In other words, according to this variant, each connector has its own O-ring between the connector and the pump body and/or the lid to ensure the chamber is sealed at the connectors. This solution is particularly advantageous if the connectors are attached to the pump (for example, are not molded with the pump body or the lid) and are distant from each other and/or are not in the same plane.

Advantageously, the inlet and outlet connectors are arranged in the same plane belonging to a single outer side of the peristaltic pump. This makes it possible to have a particularly compact pump with its connective elements assembled on the same side, thus limiting the length of the tubing required at the pump inlet and outlet.

Preferentially, the inlet and outlet connectors each advantageously comprise a bend with an angle of substantially 90°. This kind of connector facilitates the installation of the pump by placing the pump transversely in the suction and discharge ducts, respectively at the inlet and at the outlet of the pump. In this way, the size of the pump assembly and liquid tubing can be smaller.

Of course, the embodiments described above are fully compatible with each other, and other advantageous embodiments may arise from their various combinations. In particular, a peristaltic pump that would result from the combination of the three embodiments described above could be foreseen. This would result in a particularly compact peristaltic pump that is easy to manufacture and maintain because it is equipped with a lid that is inexpensive and completely watertight, regardless of its spatial orientation, in case of any rupture of the deformable hose. The sealing system would then comprise said first, second and third sealing elements previously described.

According to another embodiment, which may also constitute an invention as such, the peristaltic pump for a household appliance comprises a pump body defining a chamber in which there is a deformable hose intended to contain a liquid to be moved, as well as a liquid draining system designed, in case of rupture of the deformable hose on the peristaltic pump, to drain the liquid from the chamber to the outside of the peristaltic pump according to a controlled trajectory. Advantageously, the liquid draining system comprises at least one hole which makes it possible to control the flow trajectory of the liquid in a very economical and safe manner. "Controlled trajectory" means that the place through which the liquid will drain, i.e., flow, is defined in advance by the designers. In other words, it is known precisely where and how the liquid will drain. Advantageously, the hole diameter is comprised between 0.5 mm and 4 mm, preferentially between 1 mm and 1.5 mm. Preferentially, the liquid draining system comprises two holes, advantageously arranged close to each other, for example separated by a distance comprised between 1 mm and 5 mm, which makes it possible to increase the flow rate and thus the drain speed. The presence of a plurality of holes also makes it possible to guarantee that the pump will empty even if one of the holes were to be clogged. The total evacuation section is thus comprised between 2 mm2 and 2.5 $mm^2$ in order to ensure a sufficient drainage flow rate. Preferably, the draining system is arranged to pass through the pump body or through the pump cover or through the pump body and the cover. In other words, the draining system can consist of any system passing through the pump body or the pump cover or the body and the cover, i.e., any system capable of connecting the chamber to the outside of the pump in a place defined in advance by design, i.e., defined by the designer.

Thus, according to this latter embodiment, if the deformable hose were to rupture, the objective is not necessarily to keep the liquid inside the chamber but rather to control its trajectory, i.e., to control its evacuation, having chosen and defined in advance, by design, exactly where the liquid will have to flow. This significant embodiment therefore makes it possible to provide, when incorporating the pump into its environment, an additional system that communicates with said draining system, for example to collect and store the liquid (by means of a reservoir, for example) or drain and evacuate the liquid (for example by means of a hose or a hole as will be detailed below).

Of course, this embodiment is compatible, even advantageously complementary, to the embodiments described above. Moreover, the combination of this draining system and the sealing system makes it possible, in a very significant manner, to fully secure the operation of the peristaltic pumps and to meet the strictest standards. In fact, if the pump's deformable hose were to rupture, two systems combine to prevent uncontrolled leaks from the pump, on the one hand, and on the other hand to control the liquid's flow and trajectory. Thus, irrespective of the spatial orientation of the pump, the liquid will always flow through the draining system, i.e. the liquid will be safely evacuated to a specific location defined in advance in the design phase. Indeed, even if the draining device is positioned on a high end with respect to the pump orientation, the liquid will still flow through this draining system, after the chamber has completely filled. Given the presence of the sealing system, no liquid can leak from an unwanted location on the pump (such as the gap between the drive shaft and the pump body or between the pump body and the connectors or between the pump body and the cover). In other words, irrespective of the pump orientation, the liquid accidentally present in the chamber will only flow through the draining system to a defined place and according to a controlled trajectory, these elements having been defined and selected in advance, by design.

In addition, such a construction has a particular advantage when the pump is connected to a relatively large reservoir, at least relative to the amount of liquid that the deformable hose on the pump may contain. Indeed, the draining system prevents water from accumulating in the pump chamber and therefore keeps the pressure from increasing inside the chamber. The controlled evacuation of the liquid also makes it possible to drain, according to a controlled trajectory, all of the liquid from the fluid circuit and therefore to bring, as quickly as possible, the system to the safest possible state, i.e. without liquid.

In addition, such construction with the combination of the sealing system and the draining system ensures the safety of the pump if one of the systems fails. For example, if the sealing system was faulty, for example due to excessive wear, the liquid accidentally present in the chamber would flow according to a trajectory controlled by the draining system, i.e., to a place that was defined and is known in advance. Conversely, if the draining system were to fail, for example to clog, then the liquid accidentally present in the chamber would remain tightly sealed inside it. In other words, this construction offers a double safety system: sealing system and draining system.

The invention also relates to a household appliance comprising a peristaltic pump according to any one of the preceding embodiments. Preferentially, said appliance is a hairstyling appliance, in particular an appliance for shaping hair such as a straightening or curling appliance.

According to a preferential embodiment, the appliance comprises a first branch and a second branch articulated between each other by a hinge so as to form a styling iron. The appliance thus forms a straightening iron that allows for great ease of use and optimal hairstyling results.

Advantageously, the first branch comprises a reservoir and a first surface for treating the hair by contact, the liquid evacuation system being located between the reservoir and the first treatment surface. Such an arrangement makes it possible to have a particularly compact hairstyling appliance. In addition, the arrangement of the evacuation system between the reservoir and the first treatment surface makes it possible to prevent the latter from coming into contact with the liquid that might accidentally be inside the branch, which prevents the liquid from coming into contact with the hair. This is also particularly useful and safe in the event that the first treatment surface is a surface heated by an electrical heating element (PTC, for example). Preferentially, the liquid evacuation system is located at a distance comprised between 10 mm and 50 mm from the edge of the first treatment surface, preferentially between 20 mm and 30 mm. This makes it possible in particular to maintain a safe distance from the first treatment surface and in particular from its electrical heating element.

The term "treatment surface" used above refers to any type of surface, regardless of its shape, dimensions, from the time it comes into contact with the hair in at least one place. The treatment surface can be either continuous, for example formed by a single part, or on the contrary discontinuous, for example formed by a plurality of parts. As a non-limiting illustration, the treatment surface can be:

- smooth and flat, for example being formed by a straightening plate,
- smooth and curved, for example being formed by a mandrel, a roller or a flat iron,
- wavy, for example, comprising a succession of hollows and bumps,
- rough, for example, including bristles or teeth,
- etc.

Preferentially, said appliance comprises an electric motor, a reservoir intended to contain a liquid to be moved to a liquid consumption device, the inlet connector is connected to the reservoir, the outlet connector is connected to the liquid consumption device, the drive shaft is connected to a motor shaft on the electric motor and the peristaltic pump is arranged between the reservoir and the liquid consumption system.

According to the embodiment described above in which the peristaltic pump comprises a liquid draining system, said appliance advantageously comprises a housing comprising the peristaltic pump and at least one electrical or electronic component, the housing comprising a liquid draining system designed to evacuate the liquid out of the housing. Said evacuation system is then arranged such that the liquid cannot come into contact with the electrical or electronic component, and said draining system communicates with the evacuation system.

Thus, due to this embodiment of the invention, in the event of the unforeseen or accidental presence of liquid inside the pump, the liquid is rapidly evacuated according to a trajectory controlled in advance by the designers and to a specific location, thus avoiding any accidental contact between the liquid and any electrical or electronic component. More specifically, by means of the liquid draining system the liquid is first evacuated from the pump to a specific space that has been defined in advance, then evacuated from the appliance by means of the evacuating system, which communicates with the pump draining system. Thus, the draining and evacuation systems communicate with each other by any watertight means. For example, the pump draining system can be connected to the appliance evacuation system by means of a pipe or the draining system and the evacuation system can be connected to each other, for example one above the other.

Preferentially, the liquid evacuation system comprises at least one opening, and preferentially two openings, through the housing. This makes it possible to control, and preferentially to increase, the liquid evacuation flow rate in a particularly reliable and inexpensive manner. The opening can be of any shape. However, said hole is preferably a hole with a diameter comprised between 0.5 mm and 4 mm, preferentially between 1 mm and 1.5 mm. Given the plurality of openings, the evacuation section is advantageously comprised between 1 $mm^2$ and 4 $mm^2$ and preferentially between 2 $mm^2$ and 2.5 $mm^2$.

Advantageously, the liquid evacuation system is permanently open to the surroundings, in this case, the atmosphere. In other words, the liquid evacuation system has no plug or any other obstructing or sealing element.

Preferentially, the liquid draining system passes through the pump body.

Advantageously, the peristaltic pump comprises a cover mounted on the pump body and the liquid draining system can be arranged to pass through the cover.

In other words, the draining system can consist of any device passing through the pump body, the pump lid or the pump body and the lid, i.e., any device capable of connecting the chamber and the outside of the pump in a place defined in advance by design.

Preferentially, the liquid draining system comprises at least one hole, said at least one opening and at least one hole, being arranged facing each other, i.e. one opposite each other. This arrangement makes it possible to have a particularly compact and inexpensive appliance in that the distance between the draining and evacuation systems is minimized.

Advantageously, a sealing element, preferably an O-ring, is arranged between said draining and evacuation system, which makes it possible to guarantee the sealing between the pump and the housing on the appliance, thus avoiding any risk of accidental contact between the liquid and the electrical component or components of the appliance. In other words, according to this arrangement, any liquid that might get inside the pump chamber if the deformable hose were to rupture is directly evacuated outside the housing containing the pump in a well-considered and controlled manner, in particular by having defined precisely where the liquid should be evacuated in the design phase. In addition to improving safety, evacuating the liquid out of the appliance will allow the user to be alerted, at least visually, that a malfunction has occurred inside his/her hairstyling appliance (in this case that the deformable hose has ruptured, for example).

BRIEF DESCRIPTION OF THE DRAWINGS

The following description of a preferential and non-limiting embodiment of the hairstyling appliance highlights the characteristics that are the subject-matter of the present invention. This description is based on illustrations, including.

DETAILED DESCRIPTION

Figure 1:
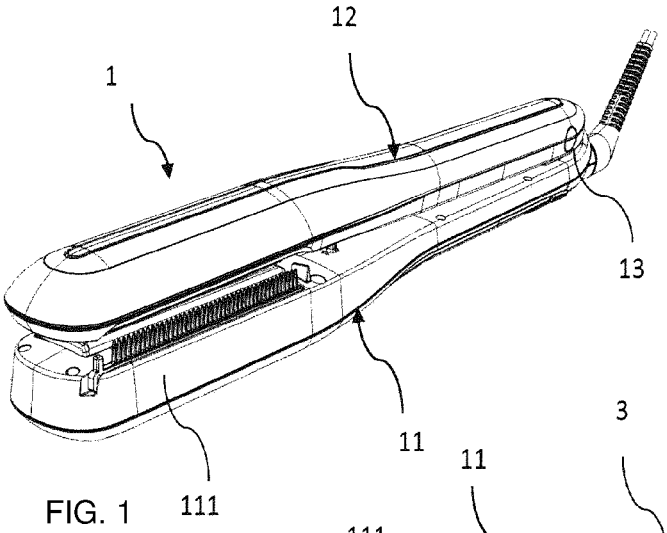
FIG. 1 illustrating a hairstyling appliance as described by the invention from a perspective view, FIG. 2 illustrating the appliance in FIG. 1 from another angle, FIG. 3 illustrating a perspective view of the first branch of the appliance in FIG. 1, FIG. 4 showing a detailed perspective view of area A in FIG. 3

As illustrated in FIG. 1, the household appliance 1 as defined by the invention is a hairstyling appliance and more specifically a straightener equipped with a liquid consumption system 4. More specifically, the liquid consumption system 4 comprises a vaporization means 41, in this case a vaporization chamber, and a diffusion means 42 of the steam thus produced, toward a lock of hair. The diffusion means 42 can in particular be formed by a series of openings, as illustrated, or even by a slot or a diffusion groove. Such elements are well known to the person skilled in the art, and are detailed in the applicant's patent EP 2 449 909, for example.

The household appliance 1 comprises a first branch 11 and a second branch 12 connected to each other by a hinge 13 disposed substantially at the end of each of said first branch 11 and second branch 12. The branches can therefore be moved with respect to each other in a rotating movement and more precisely in a clamping movement.

Figure 2:
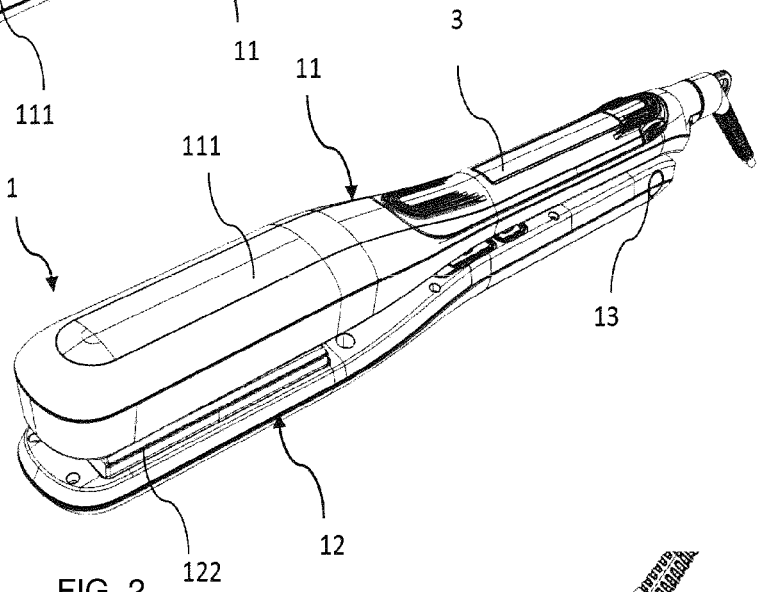
Figure 3:
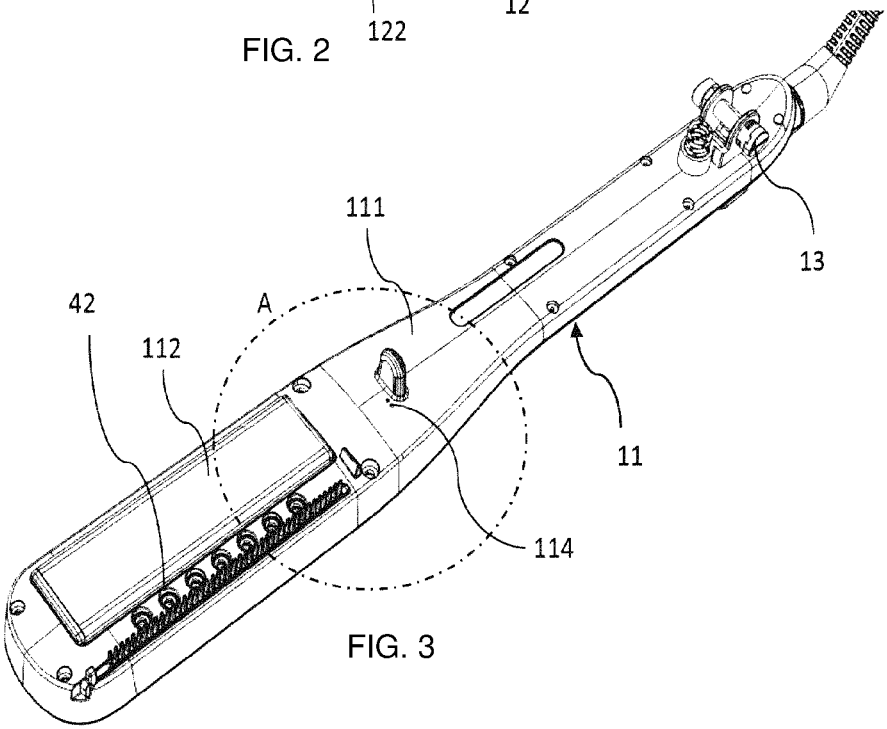

As can be seen in FIG. 3, the first branch 11 comprises a first surface 112 for treating the hair by contact, in this case a heating plate. The second branch 12 comprises a second surface 122 for treating the hair by contact, which can be seen in FIG. 2, that is complementary to the first treatment surface 112. Preferably, the second surface 122 for contact treatment is also heated.

In a manner that is well known as such, the hinge 13 allows the user to open the straightening iron in order to place a lock of hair between the treatment surfaces 112, 122, then to close the iron on the lock of hair to shape, generally to straighten.

As can be seen in FIG. 2, the household appliance 1 also comprises a liquid storage system, in this case a reservoir 3. Preferentially, the reservoir is intended to store water. However, it could be envisaged without departing from the scope of the invention that the reservoir can also store a cosmetic product, optionally diluted in water.

According to the illustrated invention, the reservoir is built into the first branch 11. However, it is altogether possible, without departing from the scope of the invention, for the reservoir to be separate from the first branch 11 and the second branch 12. The reservoir can in fact be positioned at a distance from the first branch 11, and the second branch 12, and be in a remote base, for example (i.e. located at a distance from the iron) connected to one of the branches by a hose that can convey the liquid. Such an arrangement is described in the applicant's patent EP 2 449 912, for example.

Figure 4:
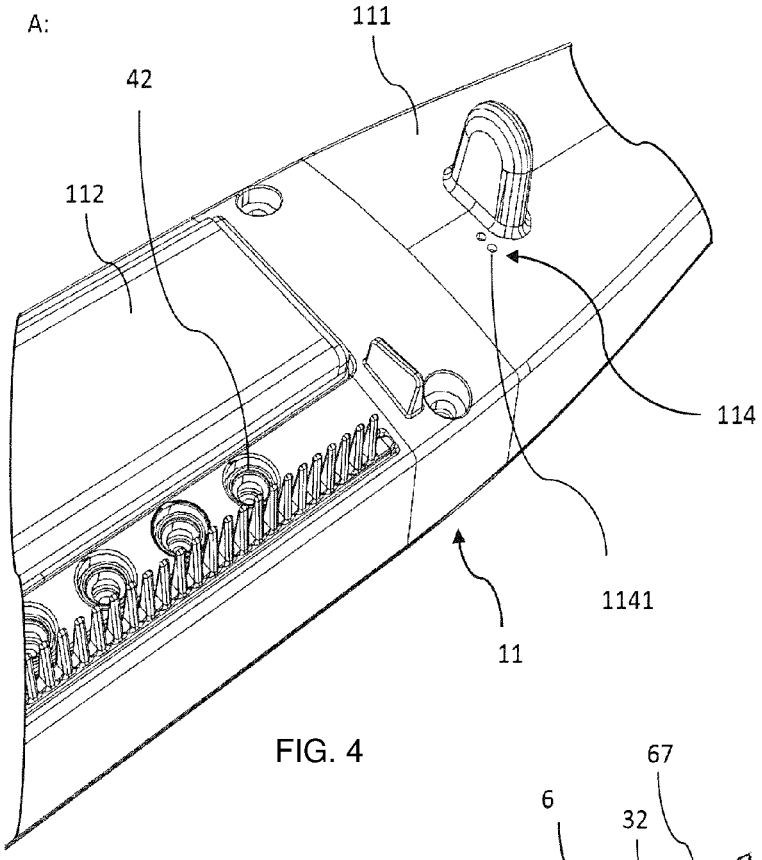

As can be seen in FIGS. 3 and 4, the household appliance 1 comprises a housing 111 formed by the first branch 11. However, although this is not illustrated, it is altogether possible without departing from the scope of the invention that the housing is formed by the previously-mentioned remote base.

The housing 111 thus forms a shell, for example made of plastic material, containing at least one electrical or electronic component, such as a heating element (PTC for example), an electric motor 5, a temperature sensor, a capacitor, an electronic card, etc. These elements are usually very sensitive to any contact with a liquid, and particularly water; such contact may result in their damage, even their destruction, and even lead to a risk of electrocution.

In order to supply liquid to the liquid consumption system 4, and preferentially with water, the household appliance 1 comprises a liquid transporting system, in this case a peristaltic pump 6. According to the illustrated invention, the peristaltic pump 6 is built into the first branch as can be seen in FIG. 5, but it is also possible, without departing from the scope of the invention, that the peristaltic pump 6 is built into the remote base mentioned above.

Figure 5:
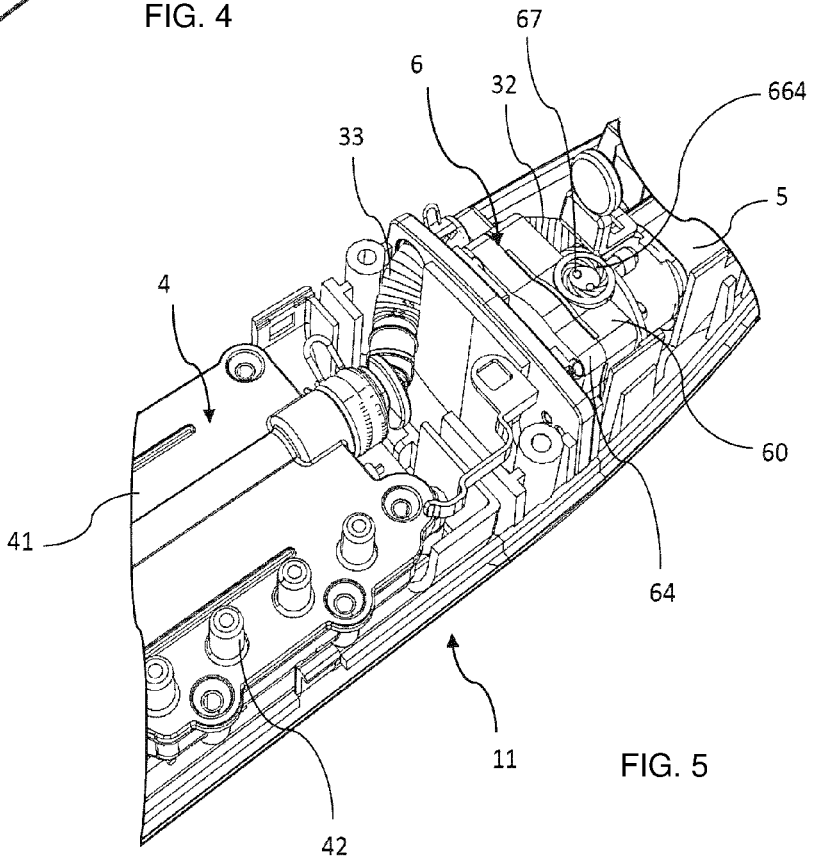
FIG. 5 showing the same detail A as FIG. 4 but with certain parts that have been masked in order to see the inner components of the branch.
Figure 6:
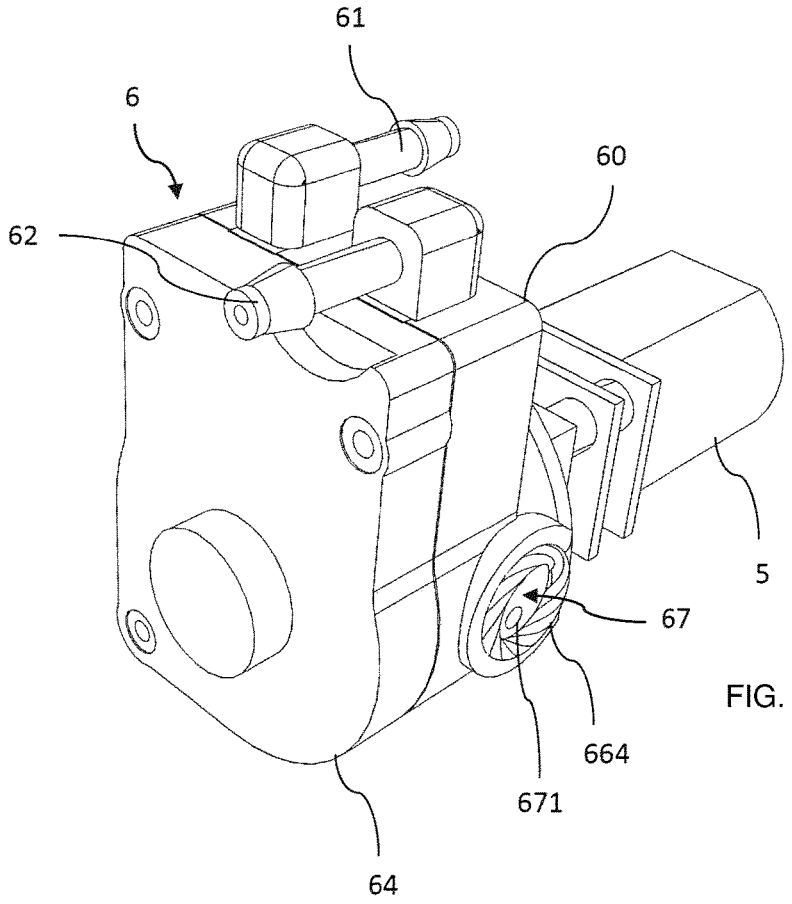
FIG. 6 is a perspective view of a peristaltic pump as defined by the invention.

As can be seen in FIGS. 5 and 6, the peristaltic pump 6 comprises in particular a pump body 60. An inlet connector 61 is arranged on the pump body 60 in order to connect the peristaltic pump 6 to a suction duct 32, itself connected to the reservoir 3. An outlet connector 62 is arranged on the pump body 60 in order to connect the peristaltic pump to the liquid consumption system 4, by means of a discharge duct 33. More specifically, each of the inlet connector 61 and outlet connector 62 pass through the pump body 60. Thus, a portion of the inlet connector 61 and of the outlet connector 62 protrudes outside of the pump, and a portion of the inlet connector 61 and of the outlet connector 62 protrudes into the pump, i.e., in a chamber 68. The parts of the inlet connector 61 and outlet connector 62 projecting outside the pump are then respectively connected to the suction duct 32 and to the discharge duct 33, as can be seen in FIG. 5. The portions of the inlet connector 61 and the outlet connector 62 that protrude into the chamber 68 are then connected to a deformable hose 63.

Figure 7:
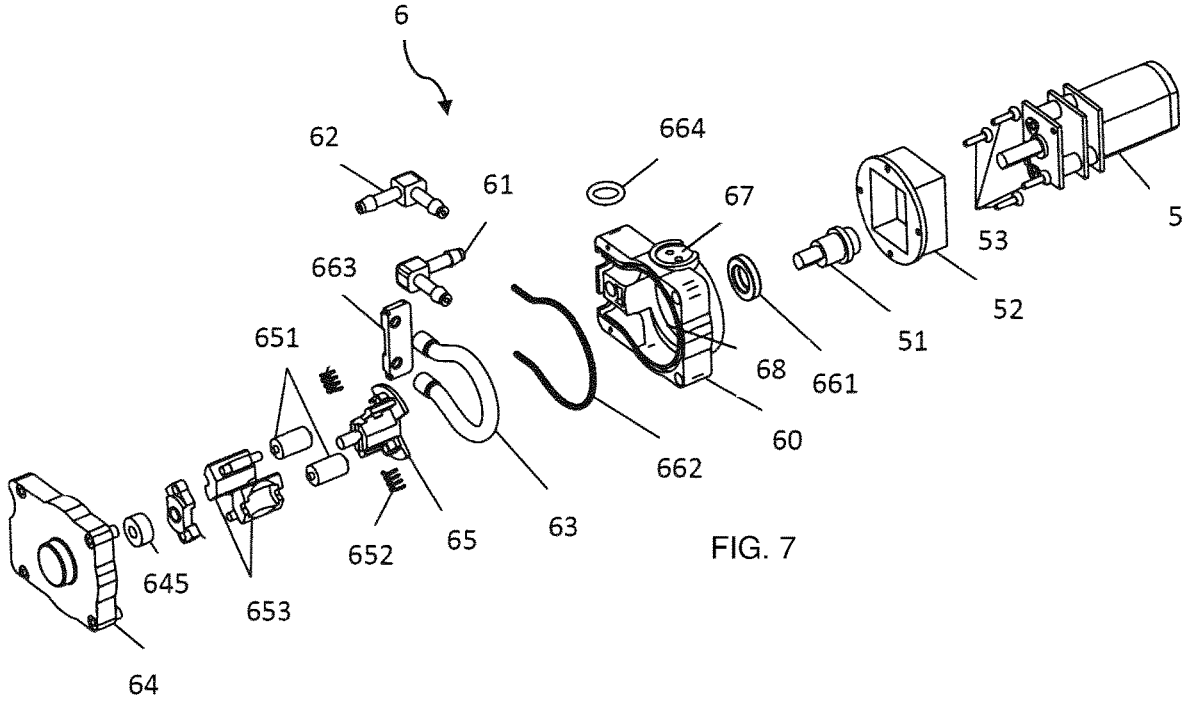
FIG. 7 showing an exploded view of the pump components in FIG. 6.

Advantageously, as can be seen in FIGS. 6 and 7, the inlet connector 61 and outlet connector 62 each comprises a bend, preferentially with a 90° angle. Preferably, the bend is outside the peristaltic pump 6, in contact with the pump body 60. Advantageously, the bend is rigid, as are the connectors, which ensures good strength and avoids the phenomenon of inadvertent folding. The inlet connector 61 and outlet connector 62 can thus be positioned on the same side of the pump body 60, even if said side is limited in size. Indeed, the inlet connector 61 and outlet connector 62 can be positioned next to each other, as shown, or even be in contact with each other, which makes it possible to limit the size of the peristaltic pump 6 and to simplify the routing of the suction pipes 32 and discharge pipes 33. In fact, the inlet connector 61 and the outlet connector 62 can, due to their 90° bend, be turned in diametrically opposite directions while being next each other, which makes it possible to have a fluid circuit outside the pump that is particularly simple and compact. Indeed, the suction duct 32 and the discharge duct 33 are practically aligned with each other, i.e., in the same plane and practically along the same line. In addition, each of these ducts enters and exits the peristaltic pump 6 through the same pump face, i.e., through only one side. It is thus possible to position the peristaltic pump 6 in a particularly small and difficult-to-access place since it is sufficient that only one side of the pump is accessible to connect the suction pipes 32 and the discharge pipes 33.

As illustrated in FIG. 6, the pump also comprises a lid 64 that cooperates with the pump body 60. More specifically, the lid 64 is mounted on the pump body 60, which makes it possible to have a pump that is easy to assemble. In particular, the assembly of the various internal components, for example the components of a rotor 65, is facilitated. In addition, the peristaltic pump 6 can be disassembled and reassembled whenever desired, with no deterioration, for example to work on the internal components. The peristaltic pump 6 is also connected to an electric motor 5 intended to move the various moving parts of the peristaltic pump 6 and thus to move the liquid from the reservoir 3 to the liquid consumption system 4.

FIG. 7 shows the various components of the peristaltic pump 6. Thus, the pump body 60 forms a chamber 68, i.e. a space, a recess or a housing in which various elements are found. In this case, the chamber 68 is defined by the pump body 60 and is closed by the lid 64. The chamber thus contains a deformable hose 63, a rotor 65 comprising one or more pressure elements 651 connected to the rotor by a mount 653 and one or more springs 652. The deformable hose 63 is fixed and is connected, on the one hand, to the inlet connector 61 and on the other hand to the outlet connector 62 so as to form a loop. The rotor 65 is located in the center of the loop and is rotated by a drive shaft 51 that passes through the pump body 60 and is connected to the motor shaft of the electric motor 5. The rotor is guided in rotation by a 645 bearing housed in the lid. When the drive shaft rotates, the pressure elements 651, for example rollers, then regularly crush the deformable hose 63, and under the effect of their displacement consecutive to the rotation of the rotor 65, this creates a suction phenomenon but also a displacement of the liquid inside the deformable hose 63. Thus, the liquid is sucked in on one side of the pump and ejected on the other. This operation is quite classic and characteristic of the peristaltic pumps known to the person skilled in the art, so it is not further detailed here. The peristaltic pump 6 and the electric motor are both connected to a mounting plate 52, for example by means of screws 53.

As can be seen in FIG. 7, the peristaltic pump 6 comprises a sealing system 661, 662, 663. The latter constitutes a safety device that is an integral part of the pump described in detail below.

More specifically, the sealing system on the peristaltic pump 6 comprises a first sealing element 661 arranged between the drive shaft 51 and the pump body 60 (or, alternatively, the lid 64). More specifically, the first sealing element 661 is a lip seal and preferentially a double-lip seal. Such a seal is in fact highly effective to ensure complete watertightness between a rotating part, in this case the drive shaft 51, and a fixed part, in this case the pump body 60 (or optionally the lid 64). Thus, thanks to the presence of this first sealing element 661, the liquid that might possibly be inside the chamber 68, for example, in the event of rupture of the deformable hose 63 (or accidental disconnection of the inlet and/or outlet connector), could not leak out of the chamber, i.e. outside the peristaltic pump 6, through the gap, i.e., the functional clearance between the drive shaft 51 (rotating part) and the pump body 60 (fixed part). The first sealing element 661 guarantees both the effective rotation of the drive shaft 51 relative to the pump body 60 (or possibly the lid) while guaranteeing the sealing between these two parts.

According to the illustrated embodiment, the peristaltic pump 6 also comprises a second sealing element 662 arranged between the pump body 60 and the lid 64, as can be seen in FIG. 7. This second sealing element 662 is advantageously formed by a circular cross-section seal. The second sealing element 662 is then arranged around the chamber 68, near the rim, i.e., the edge of the pump body 60 and of the lid. As can be seen in FIG. 7, the second sealing element 662 follows the contour of the pump body 60 and the lid 64, and therefore assumes its shape. The second sealing element 662 nearly forms a loop in itself; however, this element has two ends, i.e., it is not a closed ring. Thus, once installed between the pump body and the lid, the second sealing element 662 takes the form of a horseshoe or even the Greek capital letter Omega. The presence of this second sealing element 662 thus makes it possible to ensure the sealing between the pump body 60 and the lid 64, while allowing for dismantling and reassembly of the lid 64. However, it can be seen that this second sealing element 662 does not fit completely around the pump body 60. In other words, the second sealing element is not positioned around the entire rim of the chamber 68 but on at least 60% and preferentially 80% of the rim of the chamber 68. The remaining portion of the rim is then sealed by a third sealing element 663, as will more specifically be described below, which makes it possible to ensure a complete seal between the pump body 60 and the lid 64, and thus the watertightness of the chamber 68.

As can be seen in FIG. 7, the peristaltic pump also comprises a third sealing element 663. The latter comprises a plate through which the inlet connector 61 and the outlet connector 62 pass. Preferably, the plate is made of silicone, or of any other material that can ensure a seal. The plate then comprises two openings allowing the inlet connector 61 and the outlet connector 62 to be passed through it. The plate is made of a material that is sufficiently flexible to ensure the sealing around said inlet connector 61 and outlet connector 62. The plate is thus in contact with the inlet connector 61 and the outlet connector 62, with the pump body 60, and also with the lid 64 as can be seen in FIG. 7. This plate makes it possible, in a significant manner, in combination with the second sealing element 662 described above, to complete the watertightness of the chamber 68, i.e. to complete the seal between the lid 64 and the pump body 60, by closing the rim of the chamber.

Thus, due to the combined presence of the sealing elements described above, namely the first sealing element 661, the second sealing element 662, and the third sealing element 663, the chamber 68 is completely watertight. Consequently, if liquid were accidentally to escape from the deformable hose 63 (rupture or disconnection of the deformable hose 63) and get into the chamber 68, the liquid, which is usually water, would be confined to the chamber 68 without being able to escape. This makes it possible to obtain a peristaltic pump that is particularly safe because it is completely watertight, i.e., it cannot allow liquid to escape, even if its deformable hose were to rupture. It is then possible to use the peristaltic pump of the invention in certain places where the presence of liquid is prohibited, for example in the immediate vicinity of electrical or electronic components.

However, the invention as illustrated comprises another safety device, which may moreover constitute an invention as such. Indeed, the pump illustrated in FIGS. 6 and 7 comprises a draining system 67 designed, in case of rupture of the deformable hose 63 on the peristaltic pump 6, to drain the liquid from the chamber 68 to the outside of the peristaltic pump 6 according to a controlled trajectory. This safety device is particularly effective when used on a household appliance 1 comprising a liquid evacuation system 114, as detailed below.

As can be seen in FIGS. 5 to 7, the peristaltic pump 6 comprises two holes 671 which then form a draining system 67 connecting the chamber 68 to the outside of the pump at a specific place judiciously selected by the designers. Each hole has a diameter of approximately 1.2 mm, which corresponds to an evacuation section of 2.26 $mm^2$ The holes are 2.5 mm apart. Thus, if liquid accidentally (due to the causes mentioned above) gets into the chamber 68, it is possible to control the flow trajectory of the liquid to a specific place, considered and selected in advance by the designers. For example, it is then possible to keep the liquid flow away from any electrical or electronic component, due to the position of the draining system.

By combining the draining system 67 with the sealing elements 661, 662, 663 defined above, as illustrated, the controlled draining of the chamber 68, after a rupture of the deformable hose 63, solely by the draining system 67, is guaranteed regardless of the spatial orientation of the pump. Indeed, if the pump is oriented according to FIG. 6, then the liquid will naturally flow, by gravity, through the draining system 67 which is then positioned at a lower point on the pump body. In this case, the first sealing element 661 and the third sealing element 663 are not required for adequate flow solely by the draining system since these elements are then positioned above the draining system 67. On the other hand, if the pump is oriented differently, for example with the inlet connector 61 and outlet connector 62 at the bottom, the draining system 67 is then positioned at a high point on the pump. If there is no third sealing element 663, the liquid could then leak through the gap between the pump body 60 and the inlet connector 61 and outlet connector 62. If there is no second sealing element 662, the liquid could also escape through the gap between the drive shaft 51 and the pump body 60, before it even got to the draining system 67. The liquid leak would then be uncontrolled, as is the case with the pumps of the prior art when the deformable hose breaks. Due to the previously-described sealing elements 661, 662, 663, the water cannot leak through these gaps and is therefore forced to flow through the draining system 67 and only through the draining system 67. In addition, the presence of said sealing elements 661, 662, 663 makes it possible to avoid any unwanted flow of liquid, i.e., elsewhere than through the draining system, if the latter were to clog or fail to ensure a sufficient flow rate to empty the chamber quickly enough.

As can be seen in FIG. 4, the housing 111 comprises a liquid evacuation system 114 designed to evacuate the liquid out of the housing 111 in the event of liquid leakage from the liquid transporting system 32, 6, 33, in this case a peristaltic pump 6 or a hose 32, 33, and/or from the liquid storage system, in this case a reservoir 3. The liquid evacuation system 114 is arranged such that the liquid cannot come into contact with the electrical or electronic component. More specifically, the liquid evacuation system 114 comprises two holes 1141 arranged next to each other. Each of the holes 1141 passes through the housing 111, so as to connect the inside of the housing 111 to the outside. Using two separate openings ensures sufficient evacuation flow and guarantees minimum flow if one of the openings 1141 became clogged. As illustrated in FIG. 4, each opening 1141 is a hole with a diameter substantially equal to 1.2 mm. Thus, the possible evacuation section is approximately 2.26 $mm^2$ The holes are separated by approximately 2.5 mm.

The liquid evacuation system 114 is located at a distance of approximately 25 mm from the edge of the first treatment surface 112, which ensures a safe distance when water flows through the evacuation system 114 and prevents the evacuated liquid from coming into contact with the first treatment surface 112. The liquid evacuation system 114 is located opposite the second branch 12, which makes it possible to mask it when the straightener is closed, thus improving overall aesthetics.

According to the illustrated embodiment of the invention, the draining system 67 on the peristaltic pump 6 communicates with the evacuation system 114 on the housing 111. In this case, as can be seen in FIGS. 4 and 5, draining system 67 is positioned facing the evacuation system 114. In other words, the draining system 67 is positioned opposite the evacuation system 114. More specifically, the draining system 67 comprises two holes 671 and the evacuation system 114 also comprises two openings 1141, each of the holes 671 belonging to the draining system 67 being arranged facing, i.e. opposite, one of the openings 1141 in the evacuation system 114.

Advantageously and significantly, the draining section of the draining system 67 and that of the evacuation system 114 are substantially identical and about 2.26 mm2 in size, which guarantees the complete drainage of any liquid that might be in the chamber 68 with no funnel phenomenon.

The draining system 67 and evacuation system 114 are thus separated by a sealing element 664 ensuring the sealing, in this case an O-ring, between the draining system and the evacuation system 114. The sealing element 664 is held in a slot around the draining system 67 and is thus in contact with the housing 111 and the peristaltic pump 6, and in particular the pump body 60. By means of this embodiment of the invention, if the deformable hose 63 in the peristaltic pump 6 of the household appliance 1 were to rupture, the liquid would then be evacuated in a controlled manner, defined by design, in other words, in a well-considered manner, solely by the evacuation system 114 and via the draining system 67 on the peristaltic pump 6, such that the liquid cannot come into contact with any electrical or electronic component located inside the housing 111. In other words, the interior of the housing 111 is protected from any liquid, even in the event of failure of the peristaltic pump 6, which considerably improves the safety of the household appliance 1, be it for the appliance itself (its electrical or electronic components) or for the user (risk of electrocution).

The invention claimed is:

1. A household appliance, comprising a reservoir and a peristaltic pump, the reservoir configured to store a liquid, the peristaltic pump comprising:

a pump body defining a chamber, the chamber enclosing a deformable hose configured to move the liquid;

an inlet connector and an outlet connector connected to the deformable hose, the inlet connector further connected to the reservoir to move the liquid from the reservoir to the deformable hose; and a sealing system configured to contain the liquid inside the chamber in event of rupture of the deformable hose, the sealing system comprising a sealing plate through which the inlet connector and outlet connector both pass, wherein the sealing plate is configured to seal the chamber at each of the inlet connector and the outlet connector.

2. The household appliance according to claim 1, wherein:

the chamber comprises a rotor in contact with the deformable hose, the rotor connected to a drive shaft passing through the pump body;

the sealing system comprises a second sealing element arranged between the drive shaft and the pump body; and the household appliance comprises an electric motor and a liquid consumption system, wherein the outlet connector is connected to the liquid consumption system, the drive shaft is connected to a motor shaft on the electric motor, and the peristaltic pump is arranged between the reservoir and the liquid consumption system.

3. The household appliance according to claim 2, further comprising:

a liquid draining system configured, in the event of rupture of the deformable hose, to drain the liquid from the chamber according to a controlled trajectory; and a housing comprising the peristaltic pump, at least one electrical or electronic component, and a liquid evacuation system configured to evacuate the liquid outside the housing, wherein the evacuation system is configured such that the liquid cannot come into contact with the electrical or electronic component and the draining system is configured to communicate with the evacuation system.

4. The household appliance according to claim 3, wherein the sealing system comprises a third sealing element arranged between the draining system and evacuation system.

5. The household appliance according to claim 1, wherein:

the chamber comprises a rotor in contact with the deformable hose, the rotor connected to a drive shaft passing through the pump body; and the sealing system comprises a second sealing element arranged between the drive shaft and the pump body.

6. The household appliance according to claim 5, wherein the second sealing element comprises a lip seal.

7. The household appliance according to claim 1, wherein:

the peristaltic pump comprises a cover cooperating with the pump body; and the sealing system comprises a second sealing element arranged between the pump body and the cover.

8. The household appliance according to claim 1, wherein the inlet connector is configured to receive a liquid suction duct and the outlet connector is configured to receive a liquid discharge duct.

9. The household appliance according to claim 1, wherein the sealing element comprises two O-rings.

10. The household appliance according to claim 1, wherein the inlet connector and outlet connector are arranged in the same plane on the same outer side of the peristaltic pump.

11. The household appliance according to claim 1, wherein the inlet connector and outlet connector each comprise a substantially 90° bend.

12. The household appliance according to claim 3, wherein the liquid draining system comprises at least one hole.

13. The household appliance according to claim 3, wherein the liquid draining system is arranged so as to run through the pump body.

14. A household appliance, comprising a reservoir and a peristaltic pump, the reservoir configured to store a liquid, the peristaltic pump comprising:

a pump body defining a chamber, the chamber enclosing a deformable hose configured to move the liquid;

an inlet connector and an outlet connector connected to the deformable hose, the inlet connector and outlet connector each comprising a substantial bend, the inlet connector further connected to the reservoir to move the liquid from the reservoir to the deformable hose; and a sealing system configured to contain the liquid inside the chamber in event of rupture of the deformable hose, wherein the sealing system includes a sealing plate through which the inlet connector and the outlet connector pass, wherein the sealing plate is configured to seal the chamber at each of the inlet connector and the outlet connector.

15. The household appliance according to claim 14, wherein the substantial bend is a 90° angle.

16. The household appliance according to claim 14, wherein the substantial bend is rigid.

17. The household appliance according to claim 14, wherein the sealing system comprises a sealing plate arranged between the pump body and at least one of the inlet connector or outlet connector.

18. The household appliance according to claim 14, wherein the inlet connector is configured to receive a liquid suction duct and the outlet connector is configured to receive a liquid discharge duct.

19. A household appliance, comprising a reservoir and a peristaltic pump, the reservoir configured to store a liquid, the peristaltic pump comprising:

a pump body defining a chamber, the chamber enclosing a deformable hose configured to move the liquid;

an inlet connector and an outlet connector connected to the deformable hose, the inlet connector further connected to the reservoir to move the liquid from the reservoir to the deformable hose; and a sealing system configured to contain the liquid inside the chamber in event of rupture of the deformable hose, the sealing system comprising a sealing plate arranged between the pump body and each of the inlet connector and outlet connector, wherein the sealing plate is configured to seal the chamber at each of the inlet connector and the outlet connector.

* * * * *